United States Patent [19]

Lamb

[11] 4,415,160

[45] Nov. 15, 1983

[54] GAME APPARATUS

[76] Inventor: Herbert J. Lamb, 244 Maryland Ave., Staten Island, N.Y. 10305

[21] Appl. No.: 285,711

[22] Filed: Jul. 22, 1981

Related U.S. Application Data

[63] Continuation of Ser. No. 86,716, Oct. 22, 1979, abandoned.

[51] Int. Cl.[3] ..... H63F 3/00

[52] U.S. Cl. ..... 273/243; 273/255; 273/262

[58] Field of Search ..... 273/250–255, 273/248, 243, 262, 256

[56] References Cited

U.S. PATENT DOCUMENTS

| | | | |
|---|---|---|---|
| 2,026,082 | 12/1935 | Darrow | 273/256 |
| 2,964,323 | 12/1960 | Moses | 273/255 |
| 3,606,334 | 9/1971 | Pippin | 273/248 |
| 3,649,022 | 3/1972 | Clark, Jr. | 273/248 X |
| 3,973,775 | 8/1976 | Bolan | 273/253 |
| 4,223,892 | 9/1980 | Matherne | 273/248 |
| 4,227,695 | 10/1980 | Neal, Jr. | 273/255 |
| 4,359,226 | 11/1982 | Neff | 273/243 |

*Primary Examiner*—Richard C. Pinkham
*Assistant Examiner*—Scott Brown
*Attorney, Agent, or Firm*—Owen L. Lamb

[57] ABSTRACT

A medieval game combining both fantasy game elements and strategy game elements with chance. Each player assumes a role of a king (or queen) to manipulate men, gold, and circumstances (represented in playing cards) in an effort to gain possession of an opponent's crown. The game pieces include a game board with castles represented thereon for defending each player's crown, and squares thereon with indicia which enable a player to draw a card when a game piece lands on one of the indicia. The cards represent men, gold, attack and defend moves, and circumstances such as penalties and rewards. The play is advanced by utilizing a white knight game piece and a black knight game piece for each player. The game pieces advance around the board in accordance with chance, such as the throw of a dice.

8 Claims, 3 Drawing Figures

GAME APPARATUS

This application is a continuation of application Ser. No. 06/086,716, filed Oct. 22, 1979 and since abandoned.

BACKGROUND OF THE INVENTION

1. Field of the Invention

The invention relates to games, and more particularly, to a game which places demands upon the logical skills of a player (strategy-oriented games) and the intuitive skill of a player (fantasy-oriented games) with an element of chance.

2. Description of the Prior Art

In the past, amusement games have developed in two essentially opposite directions. There are strategy-oriented games which direct themselves almost exclusively to one train of thought, logic. In the opposite direction, there are fantasy-oriented games, which direct themselves almost exclusively to the use of the imagination, and the intuitive powers. In between these two basic types of games are variations which introduce an element of chance to these basic types of games.

Representative of strategy-oriented games are chess, checkers, and modern-day computer games. Variations include three-dimensional chess, or a modified chess game in which four can play, such as that described in the Weiss U.S. Pat. No. 4,093,237. The resulting games are just more complicated, and add complexity but still appeal to a strategy-oriented type of player.

There have been attempts in the past to elevate strategy-oriented games, such as chess, by adding an element of chance. For example, the Welter U.S. Pat. No. 3,684,287 discloses a chess game to which cards have been added to introduce an element of chance. The playing cards have chess indicia thereon, representing various chess pieces, and are playable on the game board spaces which are open for play. This patent does not, however, introduce the fantasy element which would require one to use one's intuitive powers. Similarly, the Bialek U.S. Pat. No. 3,794,326 adds dice to a chess game to introduce an element of chance. The dice have different symbols of chess pieces on each face. The player throws the dice and is able to move his chess piece on the board in accordance with which face of the dice turns up. Again, no fantasy element is introduced whereby a player must use intuitive powers.

Attempts have been made in the past to raise a strategy-oriented game, such as chess, to a fantasy level. An example is the Suvada U.S. Pat. No. 3,408,073 which discloses a chess game in which the game pieces have different colors by which a player can imagine the former king, former rook, etc. by distinguishing color. While this game does introduce a small element of fantasy requiring the use of one's imagination, it does not require a substantial use of these intuitive powers, nor does it introduce any element of chance.

There are various ways of introducing the element of chance to a game. For example, in the Lucke U.S. Pat. No. 855,192 four decks of cards are utilized to introduce chance to the game. For example, a wealth deck utilizes money bags on the card representing the value of the contents of the cards in the suit. Similarly, in the Buhler-Rossbach U.S. Pat. No. 1,705,141, symbols are utilized on the game board to represent which cards can be drawn from a deck of cards by a player. For example, a sword on a card represents a weapon card. While these patents do represent games based mainly on change, they do not utilize the elements of chance to raise the level of a fantasy-oriented game to the same sophisticated level as a strategy-oriented game.

Finally, the element of change has been introduced into a strategy-oriented game in order to change the area on the game board in which the strategy is employed. This is represented by the Magiera U.S. Pat. No. 3,977,677. In this game, dice are employed to introduce chance into the game by moving an attacking knight exactly to a square based upon the count of one or both of the dice roll numbers. The game utilizes knights to attack, and pawns to defend with the possibility of capturing an opponent's knight, the object of the game being the accumulation of the largest number of chips. While this game introduces a large amount of chance, it is still basically a strategy-oriented game, and does not require a substantial use of one's intuitive powers. The game does not utilize a deck of penalty/reward cards from which a player would draw depending upon the throw of the dice.

There is a need for an amusement game which draws upon both the logic powers and the intuitive powers of the players. Current strategy-oriented games direct themselves almost exclusively to one train of thought, logic. There is a need to maintain the same level of play and challenge but still to incorporate the element of chance and fantasy.

Strategy-oriented games appeal to only one type of player making these games, such as chess, exclusive. There is a need for a game that appeals to more than one type of player, to provide a battleground where two unrelated types of players can have an equal chance to win by employing strategy, luck, intuitive, impulsive, and emotional elements of games.

SUMMARY OF THE INVENTION

It is a primary object of this invention to provide a game apparatus which employs a balance of the elements of chance, the elements of strategy, and the elements of fantasy.

It is a further object of this invention to provide a game apparatus which raises the level of fantasy-oriented games to the same sophisticated level as strategy-oriented games, thereby achieving a middle ground between two opposite game directions.

It is also an object of this invention to provide a game apparatus set in medieval times wherein players assume the role of kings and manipulate men, gold, and circumstances in an effort to possess the opposing player's crown.

Briefly, the above objects are accomplished in accordance with the invention by providing a game apparatus which includes a game board which has a center field symbolizing a village square, subdivided into a plurality of panels. Some of the panels have first indicia representing men, and others of the panels have second indicia representing money. The game apparatus further includes a game piece, such as a white knight, which upon landing upon one of the panels, by chance, entitles a player to draw a card from a number of decks of cards. At least one of the decks of cards represents men and is identified by the first indicia. Another of the decks of cards represents money, and is identified by the second indicia. Thus, a player is able to accumulate men and wealth during a first level of play.

As the game progresses to a second level of play, a second game piece, such as a black knight, is given power, represented by the men and wealth, to wage an attack upon an opponent, through the use of an outer field which symbolizes a battleground.

In accordance with an aspect of the invention, opposing players are provided with an area on the game board which is fortifiable by playing cards which provide certain defenses against attack by an opponent. As the game progresses around the outer track of the game board, representing an attack route, attack cards are obtained by chance. Furthermore, defense cards are obtained by chance to provide the means by which a player can defend against the attack of the opponent.

The invention has the advantage of combining the elements of strategy, fantasy, and chance in one game whereby a player wins the game by showing dexterity of wit.

The invention has the further advantage that it raises the level of fantasy-oriented games to the same level of sophistication as strategy-oriented games, thereby reaching a middle ground of two essentially opposite game directions.

The foregoing and other objects, features and advantages of the invention will be apparent from the following more particular description of a preferred embodiment of the invention as illustrated in the accompanying drawings.

Figure 1:
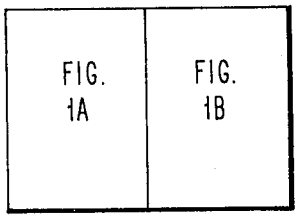
FIGS. 1A and 1B, when placed together as shown in FIG. 1, comprise a plan view of a game board.
Figure 2:
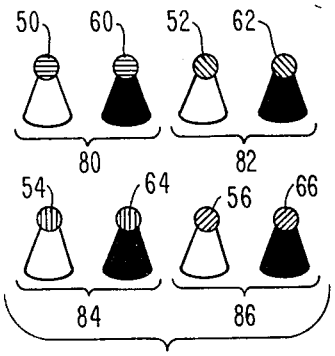
FIG. 2 is a view of four sets (80, 82, 84, 86) of game pieces for use with the game board of FIG. 1; and, FIG. 3 is a view of four decks of playing cards (70, 72, 74, 76) for use with the game board of FIG. 1.
Figure 3:
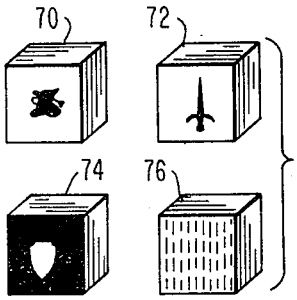
Figure 1A:
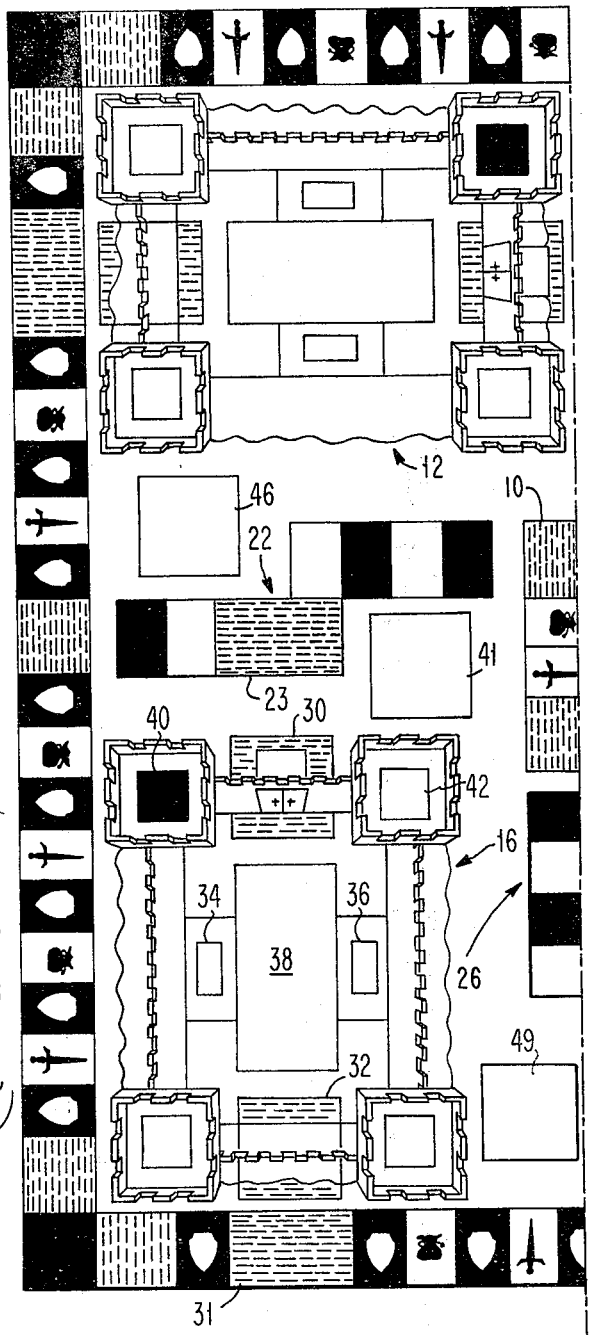
Figure 1B:
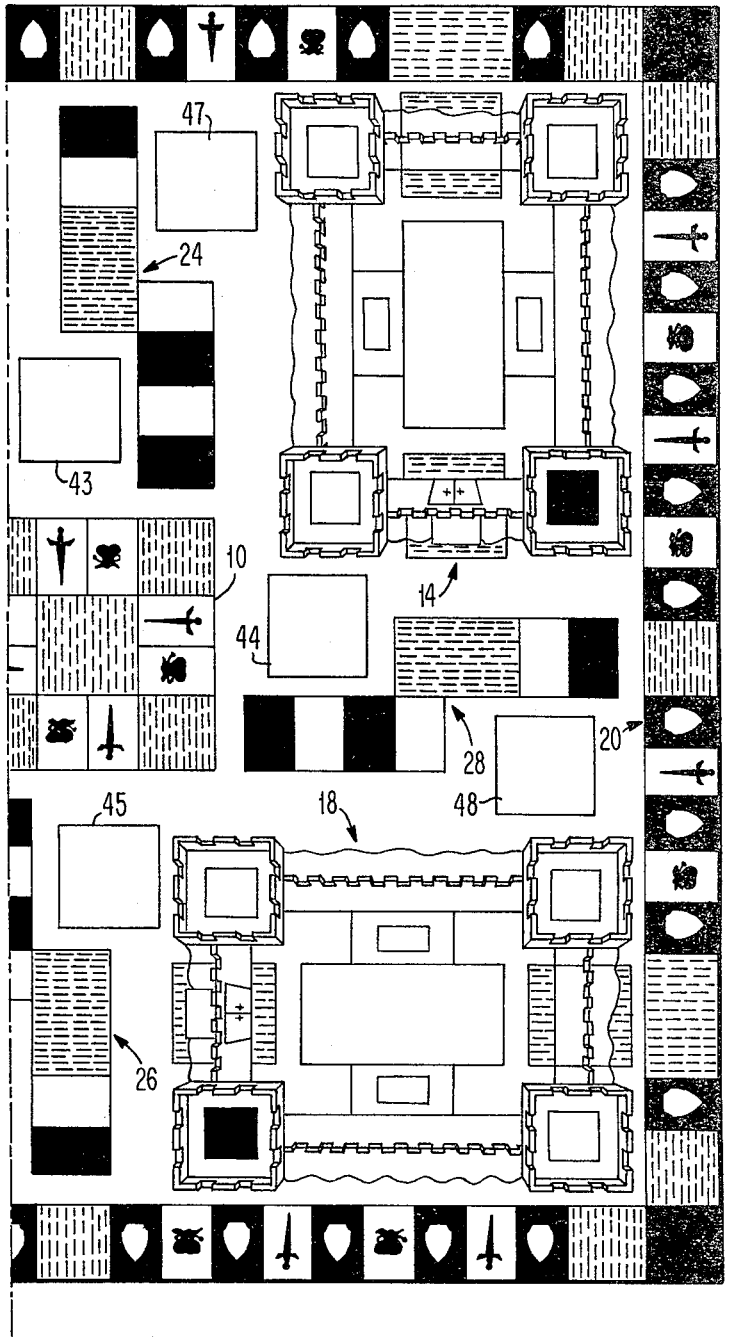

TABLE OF CONTENTS

Abstract

Background of the Invention

Field of Invention
Description of the Prior Art

Summary of the Invention

Brief Description of the Drawings

Description 1.0 The Game Board
1.1 Four Castles
1.2 The Village Square
1.3 The Outer Track
2.0 The Game Pieces
2.1 White Knight (4)
2.2 Black Knight (4)
2.3 Die (1)
2.4 Treasury (4)
2.5 Card Trays (4)
2.6 Card Decks
2.6.1 Gold Bags (16 cards)
2.6.2 Men (16 cards)
2.6.3 Castle Attack and Defend Deck (8 attack cards and 8 defense cards)
2.6.4 Jester (16 penalty/reward cards)
2.7 Crown Pieces (4 blank, 4 with crown symbols)
3.0 Rules of the Game
3.1 Equipment
3.2 Preparation
3.3 The Play
3.3.1 Rolling the Die to Advance White Knight around the Game Board
3.3.2 Empowering the Black Knight with Men and Gold
3.3.3 Rolling the Die to Advance Black Knight around the Game Board
3.3.4 Challenging Opponent's White Knight or Black Knight with a Black Knight
3.3.5 Accumulating Defense and Attack Cards by Advancing the Black Knight around the Outer Track.
3.3.6 Attacking the Opponent's Treasury to Obtain the Crown
3.3.6.1 Drawbridge Attack or Defense
3.3.6.2 Moat Attack or Defense
3.3.6.3 Obtaining the Crown
4.0 Summary

DESCRIPTION

The game consists of a game board, a die or a wheel with a spinner, four decks of cards, two game pieces per player, representing a white knight, and a black knight for each player; and crown pieces, representing the authority to rule each of four kingdoms.

1.0 THE GAME BOARD

The game board has a center field, 10, representing a village square, four castles, 12, 14, 16, and 18, defining areas of defense for opposing players, and an outer track, 20, around which game pieces travel in order to wage an attack upon the castles. Additionally, there are a series of pathways, 22, 24, 26, and 28, providing a path by which game pieces located at each of the respective castles can move to either the village square, 10, or the other track, 20.

1.1 FOUR CASTLES

The four castles are identical and include the following functional squares upon which game pieces move. Square 30 represents the drawbridge area. Square 32 represents the moat area. Squares 34 and 36 represent the treasury wherein upon one of the squares a crown piece is placed face down, and upon the other square a blank piece is placed face down. A square, 38, is set aside for storing cards representing gold stored in the treasury. Additionally, squares 40 and 42 are provided for initially placing the black knight game piece and the white knight game piece.

1.2 THE VILLAGE SQUARE

The village square, 10, is an inner track of contiguous spaces around which a game piece can move in a clockwise direction. There are 12 spaces shown. Four are color coded (purple), four have gold bag symbols on them, and the remaining four have sword symbols on them.

1.3 THE OUTER TRACK

The outer track, 20, has a number of contiguous spaces. Some of the spaces have gold bag symbols on them, some of the spaces have a shield symbol on them, some of the spaces have a sword symbol on them, and some of the spaces are color coded (purple).

The pathway spaces, 22, 24, 26, and 28, link each of the castle areas with the outer track and the village square so that a game piece originating at a castle can move sequentially space-by-space to either the village square, 10, or the outer track, 20, in accordance with the throw of die, as the game progresses.

2.0 THE GAME PIECES 2.1 WHITE KNIGHT (4 game pieces)

There is provided a white knight (50, 52, 54, 56) for each player, which is placed initially on the square, 42, of each of the castles. The white knight can move from the castle to either the village square, 10, or the outer track, 20. However, the white knight can only collect men for the army, or collect taxes, i.e., gold, for the treasury.

2.2 BLACK KNIGHT (4 game pieces)

A black knight (60, 62, 64, 66), symbolizing an army, is provided for each player. Initially, the black knight is placed on the square, 40, on each castle. The black knight cannot move around the game board until the game piece changes status and is empowered by an equal number of men and gold backing. Therefore, initially the white knight must proceed from the castle, obtain men and gold, and return to the castle. At this point, the black knight can be empowered with men and gold, and can leave the castle upon an attack route to an opposing castle to try to obtain the opponent's crown.

2.3 DIE (1)

A chance device, such as a die, is provided, which when thrown, provides a number which indicates the number of moves or spaces that a game piece can make. It should be understood that a suitable spinner, or other random number generating device, for example, in an electronic, random-number generator, can be substituted for the die.

2.4 TREASURY (4 pieces)

A treasury tray (not illustrated) can be employed to be placed over the square, 38, on each castle, in order to hold cards obtained by the white knight, which represent gold. The tray may also include space to hold cards representing men placed there to defend the crown.

2.5 CARD TRAYS (4 pieces)

A card tray (not illustrated) may be provided for each player to hold cards representing men, gold, defence, and attack cards accumulated during play.

2.6 CARD DECKS

Four separate (70, 72, 74, 76) card decks are provided. The card decks have information on the face thereof, and symbols on the other side. The symbols on the cards of three of the decks (70, 72, 74) correspond with similar symbols on the various squares of the game board. The fourth deck is symbolized by a color (purple).

2.6.1 Gold Deck (16 cards)

The gold deck (70) is symbolized by a gold bag on the side opposite to the face of each card. The deck contains four cards of 100 gold pieces denomination, four cards of 75 gold pieces denomination, four cards of 50 gold pieces denomination, and four cards of 25 gold pieces denomination.

2.6.2 Men Deck (16 cards)

The men deck (72) is symbolized by a sword. On the face of each card there is denominated the number of men the card represents. Four cards have 100 men each, four cards have 75 men each, four have 50 men each, and four have 25 men each.

2.6.3 Castle Attack and Defend Deck (16 cards)

This deck (74) is symbolized by a shield. Four cards are drawbridge attack cards, four cards are drawbridge defend cards. Four cards are moat attack cards, and four cards are moat defend cards.

2.6.4 Jester Deck (16 cards)

The jester deck (76) is symbolized by a color, such as purple. The cards either penalize a player or reward a player when he draws a card. Seven of the cards require that either a black knight or white knight landing on a purple square will send that player's black knight to the center of the village square to "talk to the village idiot."

Four cards grant a bonus if the white knight lands on a square with a sword symbol or a square with a gold bag symbol in the village square, 10.

Four cards reward the game piece drawing the card with an extra throw of the die, thereby giving additional moves to the game piece.

One card is called a jester card and is needed to enable a black knight to enter the drawbridge of an opponent.

2.7 CROWN PIECES (4 blank, 4 with crown symbols)

If two players are playing, only one castle per player is used. If four players are playing, all four castles are utilized. In either event, one crown piece and one blank crown piece are provided for each player. The crown piece is placed in the castle, face down, so that its identity is unknown to the opponent. The blank crown piece is also placed in the castle. In this manner, each opposing side has the crown in the treasury at one of two possible locations.

3.0 RULES OF THE GAME

The object of the game is not merely to acquire men and gold, or to attack an opponent's castle, but to capture the symbol of the opponent's authority, the right to rule: the crown. The winner must strip the opponent of title, not just land or money, thereby gaining the right to rule the kingdom. Therefore, the object of the game is to storm your opponent's castle and uncover the crown in the treasury.

3.1 EQUIPMENT

The equipment consists of a game board, a die, a white knight and a black knight for each player, four card decks, crown pieces and blank or dummy crown pieces. Optional equipment includes treasury trays and card-holding trays for each player.

3.2 PREPARATION

Each player places himself opposite one side of the board. Two to four players can be accommodated. Each player selects a white knight and a black knight game piece (80, 82, 84, or 86), which are preferably coordinated by color or shape with the particular player. The black knight is initially placed on square 40 of the castle, and the white knight is placed on square 42 of the castle, associated with the particular player.

Each player then secretly places one of the crown game pieces face down over one of the squares, 34, 36, in the castles belonging to the player. The players blank crown piece is placed over the remaining square in order to make it impossible for the opponent to tell visually where the crown piece has been placed.

The four card decks are shuffled and placed face down on the four squares 42, 43, 44, 45. The squares 46, 47, 48, 49 are provided for cards discarded from each of the respective card decks during play.

3.3 THE PLAY

Each player throws the die to determine the lead-off player. The highest number prevails and everyone else follows in clockwise rotation around the board. Whenever a throw of the die results in a tie, the tying players throw the die until the tie is broken. At this point in the game, all of the black knight and white knight game pieces are placed on the board at their starting positions at each castle. Play can now begin.

3.3.1 Rolling the Die to Advance White Knight around the Game Board

The lead-off player throws the die and moves the white knight game piece the indicated number of spaces from its beginning space out of the castle and onto the connecting track, 22, associated with his particular castle. Initially, the white knight must head towards the village square, 10. Some of the spaces on the village square circuit, 10, involve further action steps or have some consequence. These steps or consequences are to be completed before succeeding players take a turn. The effects of landing on a particular space are determined by the particular symbol in the space or the color of the space if the space is colored.

If the white knight reaches the village square, 10, movement in the square is in a clockwise direction from the point of entry. If the white knight game piece lands on a white space with a sword symbol, the player is entitled to draw a card from the deck of cards having the sword symbol. Thus, the white knight will accumulate the number of men indicated on the face of the card drawn. Similarly, if the white knight lands on a white space having a gold bag symbol, the player is entitled to draw a card from the gold bag deck, thereby accumulating a certain amount of wealth. The cards so drawn are stored in a card tray until some or all of them are introduced into play when the white knight returns to the castle.

Play proceeds from player to player, clockwise around the board, by throwing the die and moving game pieces accordingly. At some point one of the players will move his white knight back to the castle to the initial starting point. A white knight cannot draw cards from decks associated with symbols appearing on black squares. If either the white knight or the black knight lands on a purple square, a card must be drawn from the jester deck.

3.3.2 Empowering the Black Knight with Men and Gold

At some point a player will move his white knight a number of spaces back to the castle. This is done upon the throw of the die by exiting the village square to the connecting track, 22, and back to the square, 42, which was the initial starting point for the white knight. During his next turn, this player is able to empower the black knight sitting on the initial square, 40, provided the white knight has a number of men and the same or a greater number of bags of gold to back up the men, in equal number. For example, if the white knight had accumulated 50 men and 50 or more bags of gold, the black knight can be empowered and is able to move from the castle and attack an opponent's castle.

3.3.3 Rolling the Die to Advance Black Knight around the Game Board

Once the black knight has been empowered with men and gold, the black knight can be moved from the castle via the appropriate pathway to either the village square, 10, or the outer track, 20. The black knight moves the indicated number of spaces when the die is thrown. A black knight will draw cards from decks associated with the symbols appearing on black squares, but cannot draw cards from decks associated with symbols appearing on white squares. If the black knight lands on a colored square (purple) a card must be drawn from the jester deck. If the black knight enters the village square, no men or gold cards will be drawn; however, the black knight can challenge an opponent's white knight.

3.3.4 Challenging Opponent's White Knight or Black Knight with a Black Knight

The black knight, when properly empowered by men and gold, is able to proceed along the pathway from the castle to the village square. The black knight proceeds around the village square in a clockwise direction. If, during a player's turn at play, the black knight lands on a square occupied by an opponent's white knight, that white knight loses all cards collected prior to its return to its castle. During a challenge of a black knight by a black knight, the opposing players must display the total number of men cards empowering their respective black knight game pieces. The player with the highest amount of men wins the challenge. The losing player must forfeit the gold to the opponent and the men cards are returned to the men card deck in a discard stack. The losing player's game piece must be returned to its initial starting point at the castle.

3.3.5 Accumulating Defense and Attack Cards by Advancing the Black Knight around the Outer Track The black knight, when empowered by men and gold, can move via the pathway to the outer track. Movement around the outer track is in a clockwise direction from the point of entry. Movement can, however, transport in the following manner from any of the four corners marked by a black square. That is, if a black knight game piece lands on a black square at the corners of the game board instead of moving contiguously in a clockwise direction, the game piece can move to any corner and continue moving the appropriate number of squares determined by the throw of the die. A player must, however, move the game piece to continue in a clockwise direction at the corners. If the black knight game piece lands on a black square with a shield symbol, the player is entitled to draw a card from the deck of cards having the shield symbol. In this manner only the black knight accumulates defense and attack cards from the shield deck.

3.3.6 Attacking the Opponent's Treasury to Obtain the Crown

As the black knight game piece proceeds around the outer track, it accumulates drawbridge attack and defend cards and moat attack and defend cards. These cards are placed in a card tray for use during play.

3.3.6.1 Drawbridge Attack or Defense

If the black knight game piece lands directly on the gray square, 23, opposite the square, 30, of an opponent's castle, it is possible for the game piece to enter the castle. In order to gain entry, the player must possess a drawbridge attack card which has imprinted thereon "Jester" and has a brown color code. The player plays this card by placing it face up on the square, 30. Play proceeds to the next players, clockwise around the game board. An opponent can negate the effect of the attack card by playing an appropriate defense card. An appropriate card to defend against a drawbridge attack has the following legend on it: "Guard." A player defending his castle plays this card face up over the opponent's card to negate the effect thereof.

3.3.6.2 Moat Attack or Defense

The black knight game piece can proceed around the outer track, 20, to an opponent's castle. Upon landing on gray square 31, the player can play a moat attack card. The moat attack card has written thereon the following legend: "Attack" and has a blue color code. The player plays the card by placing it face up on the gray square, 32. Play then proceeds around the game board to the next player. An opponent can defend against this attack by playing an appropriate moat defense card, which has written thereon the following legend: "Defended" and has a blue color code. Play proceeds in this manner until one of the players does not have sufficient defense cards and a black knight game piece gains entry to the castle.

3.3.6.3 Obtaining the Crown

The game is won by obtaining an opponent's crown after gaining entry to the castle. After gaining entry by means of the most or the drawbridge, the player, on the next turn of play after gaining entry, chooses one of the squares, 34, or 36 and challenges the men cards, if any, guarding the crown. If the black knight of the challenging player has more men than those guarding the crown piece, then his opponent must turn the crown piece over. If the piece has the crown printed on its face, then the challenging player wins the game. If, however, the piece is blank, then the attacking black knight must return to its initial starting position in the black square of the players castle. An opportunity may then be given for the crown piece to be replaced on either one of the squares, 34, 36, the location of the crown being unknown to the other players.

4.0 SUMMARY

What has been described is a game apparatus which combines both fantasy game elements and strategy game elements with an element of chance. Each player assumes the role of a king (or queen) to manipulate men, gold, and circumstances (represented in playing cards) in an effort to gain possession of an opponent's crown. A game board is provided with a first inner game playing area called the village square which comprises a number of contiguous spaces upon which game pieces are played. A second outer game playing area is provided around the periphery of the board and comprises a number of contiguous spaces upon which the game pieces are also played. There are castles represented on the game board for each of the players. These castles comprise a defended zone wherein each player defends a crown. Pathways are provided which comprise a number of contiguous spaces upon which the game pieces are played. A pathway is located intermediate to the first and second game-playing areas, and adjacent to one of the castles. Similar pathways are provided for each of the other castles. In this manner, a game piece entering play from the castle area can be moved from space to space along the pathway toward either the first game-playing area or the second game-playing area.

Play is advanced by utilizing a white knight game piece and a black knight game piece for each player. The game pieces initially start at the castle areas and advance around the board in accordance with chance, such as by the throw of a die.

While the invention has been particularly shown and described with reference to preferred embodiments thereof, it will be understood by those skilled in the art that various changes in forms and details may be made therein without departing from the spirit and scope of the invention.

What is claimed is:

1. A game apparatus comprising in combination:

a plurality of first game pieces;

a plurality of second game pieces;

said first and second game pieces comprising a plurality of sets of game pieces, one set for each player of the game;

a first inner game-playing area comprising a number of contiguous spaces upon which game pieces may be played;

a second outer game-playing area comprising a number of contiguous spaces upon which game pieces may be played;

said second outer game playing area being peripheral to said first inner game-playing area;

first means associated with a first number of said spaces identifying said first number of spaces as being first-deck spaces;

second means associated with a second number of said spaces identifying said second number of spaces as being second-deck spaces;

a plurality of pathways, each pathway comprising a number of contiguous spaces upon which game pieces may be played, said pathways located intermediate to said first and second game-playing areas, said pathways forming a route between said first and said second game-playing areas, said pathways being further provided with at least one game-playing area entry point adjacent each of said first and second playing areas;

said pathways and said first and second game playing areas being structured with respect to each other such that said game pieces during play can be moved from space to space along one of said pathways toward either said first game-playing area or said second game-playing area to thereby enter one or the other of said game-playing areas via said game-playing area entry point;

a plurality of defended zones, at least one of said defended zones being adjacent one of said pathways, said one defended zone having at least one defended zone entry point, said one defended zone and at least one of said game playing areas being structured with respect to each other such that one of said game pieces during play can be moved to enter said one defended zone at said defended zone entry point;

said plurality of sets of game pieces being structurally distinguishable from each other to thereby enable one of said sets of game pieces to be associated during play with one of said game players;

a first deck of playing cards;

a second deck of playing cards;

said first deck having a first means of correlation which associates said first deck with said first-deck spacers;

said second deck having a second means of correlation which associates said second deck with said second-deck spaces;

said first-deck spaces and said first game pieces having a third means of correlation which associates said first-deck spaces with said first game pieces; and, said second-deck spaces and said second game pieces having a fourth means of correlation which associates said second-deck spaces with said second game pieces.

2. The combination in accordance with claim 1 wherein said third means of correlation comprises a particular color.

3. A game apparatus comprising in combination:

a first game piece;

a first inner game-playing area comprising a number of contiguous spaces upon which game pieces may be played;

a second outer game-playing area comprising a number of contiguous spaces upon which game pieces may be played;

said second outer game playing area being peripheral to said first inner game-playing area;

first means associated with a first number of said spaces identifying said first number of spaces as being first-deck spaces;

second means associated with a second number of spaces identifying said second number of spaces as being second-deck spaces;

at least one pathway comprising a number of contiguous spaces upon which game pieces may be played, said pathway located intermediate to said first and second game-playing area, said pathway forming a route between said first and said second game-playing areas, said pathway being further provided with at least one game-playing area entry point adjacent each of said first and second playing areas;

said pathway and said first and second game playing areas being structured with respect to each other such that a game piece entering play can be moved from space to space along said pathway toward either said first game-playing area or said second game-playing area to thereby enter one or the other of said game-playing areas via one of said game-playing area entry points, a defended zone adjacent said pathway, said defended zone having at least one defended zone entry point;

a first deck of playing cards, said first deck of cards having first indicia thereon for identifying them as first-deck cards and for correlating said first deck of cards with said first-deck spaces;

a second game piece;

a second deck of second playing cards, said second deck of cards having second indicia thereon for identifying them as second-deck cards and for correlating said second deck of cards with said second-deck spaces;

said first and second game pieces and said first and second spaces having distinguishing markings thereon for distinguishing said first game pieces and said second game pieces from each other and for correlating said first game pieces with said first number of spaces and for correlating said second game pieces with said second number of spaces.

4. The combination in accordance with claim 3 wherein said distinguishing markings comprise first and second colors.

5. A game apparatus comprising in combination:

a first deck of first playing cards;

a second deck of second playing cards;

a plurality of first game pieces;

a plurality of second game pieces;

said first and second game pieces comprising a plurality of sets of game pieces, one set for each player of the game;

a first inner game-playing area comprising a number of contiguous spaces upon which said game pieces may be played;

a second outer game-playing area comprising a number of contiguous spaces upon which said game pieces may be played;

said second outer game playing area being peripheral to said first inner game-playing area;

a plurality of pathways, each pathway comprising a number of contiguous spaces upon which said game pieces may be played, each of said pathways forming a route between said first and second game playing areas;

a plurality of defended zones, at least one of said defended zones being adjacent to one of said pathways;

a first number of said contiguous spaces being first spaces;

a second number of said contiguous spaces being second spaces;

said first spaces and said first deck having a first means of correlation which associates said first spaces with said first deck;

said second spaces and said second deck having a second means of correlation which associates said second spaces with said second deck;

said first spaces and said first game pieces having a third means of correlation which associates said first spaces with said first game pieces; and, said second spaces and said second game pieces having a fourth means of correlation which associates said second spaces with said second game pieces.

6. The combination in accordance with claims 1, 2, 3, 4, or 5 wherein said first and second game playing areas, said pathways and said defended zones comprise a game board.

7. The combination in accordance with claims 1, 2, or 5 wherein said first means of correlation is a first symbol.

8. The combination in accordance with claims 1, 2, or 5 wherein said second means of correlation is a second symbol.

* * * * *